US005542613A

United States Patent [19]

Nied

[11] Patent Number: 5,542,613

[45] Date of Patent: Aug. 6, 1996

[54] PROCESS FOR IMPACT CRUSHING OF SOLID PARTICLES

[76] Inventor: Roland Nied, Raiffeisen-Strasse 10, 86486 Bonstetten, Germany

[21] Appl. No.: 410,533

[22] Filed: Mar. 24, 1995

Related U.S. Application Data

[63] Continuation-in-part of Ser. No. 164,104, Dec. 9, 1993, abandoned.

[30] Foreign Application Priority Data

Dec. 10, 1992 [DE] Germany ..... 42 41 549.7

[51] Int. Cl.[6] ..... B02C 19/06

[52] U.S. Cl. ..... 241/5; 241/21; 241/41

[58] Field of Search ..... 241/5, 39, 40, 241/41, 42, 43, 44, 45, 21

[56] References Cited

U.S. PATENT DOCUMENTS

| | | | |
|---|---|---|---|
| 2,704,635 | 3/1955 | Trost | 241/5 |
| 2,974,886 | 3/1961 | Nagel | 241/39 |
| 3,158,332 | 11/1964 | Wilson | 241/39 X |
| 3,252,663 | 5/1966 | Kidwell | 241/39 |
| 3,688,991 | 9/1972 | Andrew | 241/5 |
| 3,701,484 | 10/1972 | Donovan | 241/39 X |
| 3,840,188 | 10/1974 | Coombe et al. | 241/39 |
| 3,857,201 | 12/1974 | Jacob | 241/5 X |
| 4,019,688 | 4/1977 | Akunov et al. | 241/39 X |
| 4,186,772 | 2/1980 | Handleman | 241/39 X |
| 4,602,743 | 7/1986 | Nied | 241/39 X |
| 4,630,556 | 12/1986 | Scheffee | 241/39 X |
| 4,807,815 | 2/1989 | Csillag et al. | 241/39 |
| 4,832,268 | 5/1989 | Haddow et al | 241/39 X |
| 5,129,586 | 7/1992 | Artemjev et al. | 241/39 X |

FOREIGN PATENT DOCUMENTS

| | | | |
|---|---|---|---|
| 1168288 | 7/1985 | U.S.S.R. | 241/5 |

*Primary Examiner*—Timothy V. Eley
*Attorney, Agent, or Firm*—Levine & Mandelbaum

[57] ABSTRACT

The present invention pertains to a process for facilitating the crushing of particles which have a low weight and are in suspension, wherein at least one portion of the suspension is accelerated to form a fluid jet with high energy content which reenters the stored suspension to cause impact between particles in the fluid jet and particles stored in the container.

5 Claims, 1 Drawing Sheet

PROCESS FOR IMPACT CRUSHING OF SOLID PARTICLES

This application is a continuation-in-part of application Ser. No. 08/164,104 filed Dec. 9, 1993 which is now abandoned.

BACKGROUND OF THE INVENTION

In the art of impact crushing, solid particles are carried by a gas stream and are disintegrated into a plurality of smaller particles of correspondingly lower weight due to impact on an impact surface.

EP 0300402 B1 pertains to the generation of extremely small particles in such a way that the particles to be crushed, which already have a relatively low weight, are first suspended in a fluid. The fluid with particles suspended in it is then accelerated and caused to impact on a surface with increased energy. To accomplish this, drop-like portions are taken from the suspension and are, in turn, caused to impact on the surface. This type of impact crushing is based on the consideration that the crushing of particles can be successfully achieved only if the weight of the particles to be crushed is not lower than a certain minimum value. If the weight of the particles to be crushed is too low, there is a the risk that they do not impact on the impact surface at all, but are drawn off with the fluid stream in front of the impact surface, or they, at best, impact on the impact surface with a very low energy and are then deflected to the side, with the suspension, and guided parallel to and along the impact surface.

It has been proposed that the solid particles to be crushed should not be simply suspended in a fluid, and the suspension thus formed should not be caused to impact on the impact surface but, instead, that the solid particles should be suspended in a first fluid, after which droplets should be formed from this suspension, and each droplet should consist of a fluid component containing, at most, only a few solid particles. Each of these droplets is separated from the respective other droplets of the same type, and the mass of these droplets is in turn carried by a carrier fluid stream and caused to impact on the impact surface. Instead of individual solid particles, which are directly carried by a carrier fluid stream and can be caused to impact on the impact surface only insufficiently because of their low weight, and are crushed correspondingly insufficiently, each solid particle is consequently first made the component of a droplet of higher weight, which is impacted with a substantially higher energy. Hence, even solid particles of extremely low weight can be further shattered as a consequence of the increased impact energy.

In practice, the first fluid is usually a liquid, and the second fluid, i.e., the carrier fluid, is a gas. The suspension of liquid and the solid particles of low weight is contained in a container, and a gas stream is blown with high energy into this container and consequently into the suspension. The gas stream carries droplets consisting of portions of liquid and solid particles suspended in it and impacts them in the manner described.

The foregoing leads to two different possibilities for achieving impact crushing.

The first possibility is, to a large extent, the above-described technique, in which the portion of suspension consisting of liquid droplets and solid particles contained in it in the smallest possible number, which portion of suspension is carried by a gas stream, is caused to impact on an impact plate.

The second possibility is a modification, in which a plurality of high-energy gas jets directed opposite each other are blown into the container containing the suspension, i.e., the impact crushing is performed by means of at least two portions of suspension accelerated against each other.

SUMMARY OF THE INVENTION

The present invention is based on the consideration that regardless of which of the two aforementioned possibilities is to take place, shattering of solid particles is brought about by the fact that impact crushing takes place within the suspension portion or within each suspension portion, by solid particles within the respective suspension portion, colliding and thus mutually shattering or disintegrating each other. The consideration is also based on the fact that the possibility of this type of impact crushing within a fluid jet consisting of fluid and solid particles increases with increasing distance from the source of the jet, because a certain swirling, which facilitates the collision of solid particles, takes place within the jet. However, the energy of the jet and, consequently, the energy exchanged among solid particles decreases with increasing distance of the jet from the source of the jet, and only a few solid particles, which are able to collide and be shattered, are finally contained in the jet in the area of entry of the carrier fluid into the suspension in the form of a high-energy jet.

The task of the present invention is to promote impact crushing in the high-energy jet of suspension portions over the greatest possible length of the jet, and to make impact crushing of solid particles possible near the source of the jet.

According to the present invention, it is not merely a second fluid of high energy that simply enters the suspension consisting of a first fluid and solid particles. Instead, the stream of the second fluid already contains a portion of the solid particles to be crushed. Importantly, the high-energy fluid jet which enters the first fluid contains solid particles that have a very high dynamic energy. The impact of the newly entering solid particles having this high dynamic energy enables them to disintegrate the solid particles in the first fluid in a region in which such disintegration has not hitherto been possible at all. The effectiveness of the disintegration in this region, which has now been made possible, is particularly effective.

The present invention will be explained in greater detail below on the basis of the drawings.

DESCRIPTION OF THE PREFERRED EMBODIMENT

Figure 1:
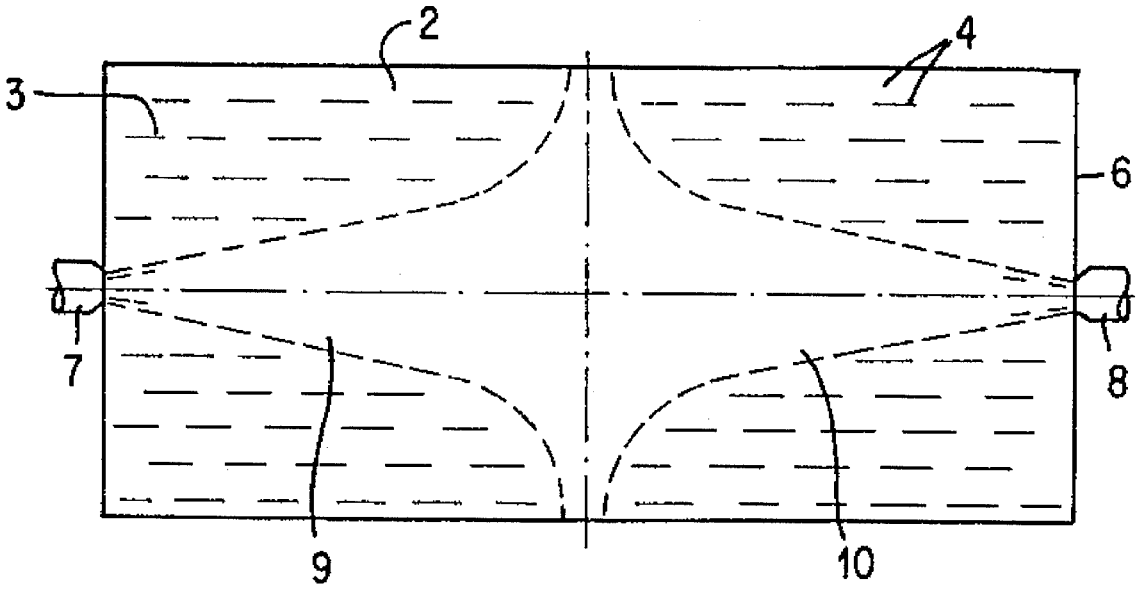
FIG. 1 is a schematic view of an apparatus for impact crushing of solid particles to which the present invention can be adapted.

Referring now to FIG. 1, a fluid 2, which may be a gas or a liquid, is present in a cylindrical container 6. Solid particles 3 are suspended in this fluid, so that the container 6 receives a suspension 4 consisting of the solid particles 3 suspended in the fluid 2. The diameters of the many, individual solid particles 3 may be between 1 and 5 μm, but the diameters are preferably already less than 1 μm. The fewest possible solid particles should, preferably, but not necessarily, be combined with a defined amount of fluid into a drop, whose diameter should be approximately 50 μm. The fluid 2 may be a gas or a liquid, but it is preferably a liquid.

Two fluid jets 9, 10 are blown at high-speed into the suspension consisting of fluid and solid particles suspended in the fluid via two nozzles 7, 8 located opposite each other in a cylindrical container 6, as a result of which solid particles are caused to impact each other and to be disintegrated into correspondingly smaller particles by the exchange of energy that takes place.

Just as the fluid 2 is preferably, but not necessarily, a liquid, the high-speed fluid jets 9, 10 are preferably gas jets, but they do not necessarily have to be gas jets.

In the solution according to FIG. 1, the solid particles are disintegrated exclusively by exchange of energy among the solid particles. An inherent problem is that an exchange of energy can take place only at a minimum distance from the nozzles 7, 8, where the energy of the gas jets, which is, of course, highest at the outlet of the nozzles, is already somewhat decreased. This has been accepted in the prior art because no exchange of energy among solid particles incorporated in each of the high-speed gas jets, nearer to the nozzles, was contemplated. What was contemplated primarily was an exchange of energy among particles that are to be assigned to one of two gas jets and particles which are to be assigned to the other of the two gas jets.

However, the present invention provides for an exchange of energy among solid particles immediately after the exit of fluid jets from one or more nozzles. Additional solid particles are therefore fed into the respective fluid jet immediately after it leaves its respective nozzle, and these additional solid particles come into contact with the suspension jet discharged from the nozzle, and exchange energy with the solid particles already present in the suspension jet immediately after leaving the nozzle, or they engage in an exchange of energy with the solid particles which arrive due to the high-speed fluid jets before the latter leave at least one of the nozzles 7, 8.

The present invention is not limited to where there are two high-speed fluid jets as in the arrangement of FIG. 1, It can also provide for the desired disintegration of solid particles even if only one of the nozzles 7, 8 is provided. Still, alternatively, the present invention can be also be used when more than two nozzles are provided in the arrangement according to FIG. 1.

The additional solid particles can be made available in different ways. However, it is particularly advantageous to provide them as portions of a suspension removed from the first suspension 4 before introduction into the region of the nozzles 7, 8.

Figure 2:
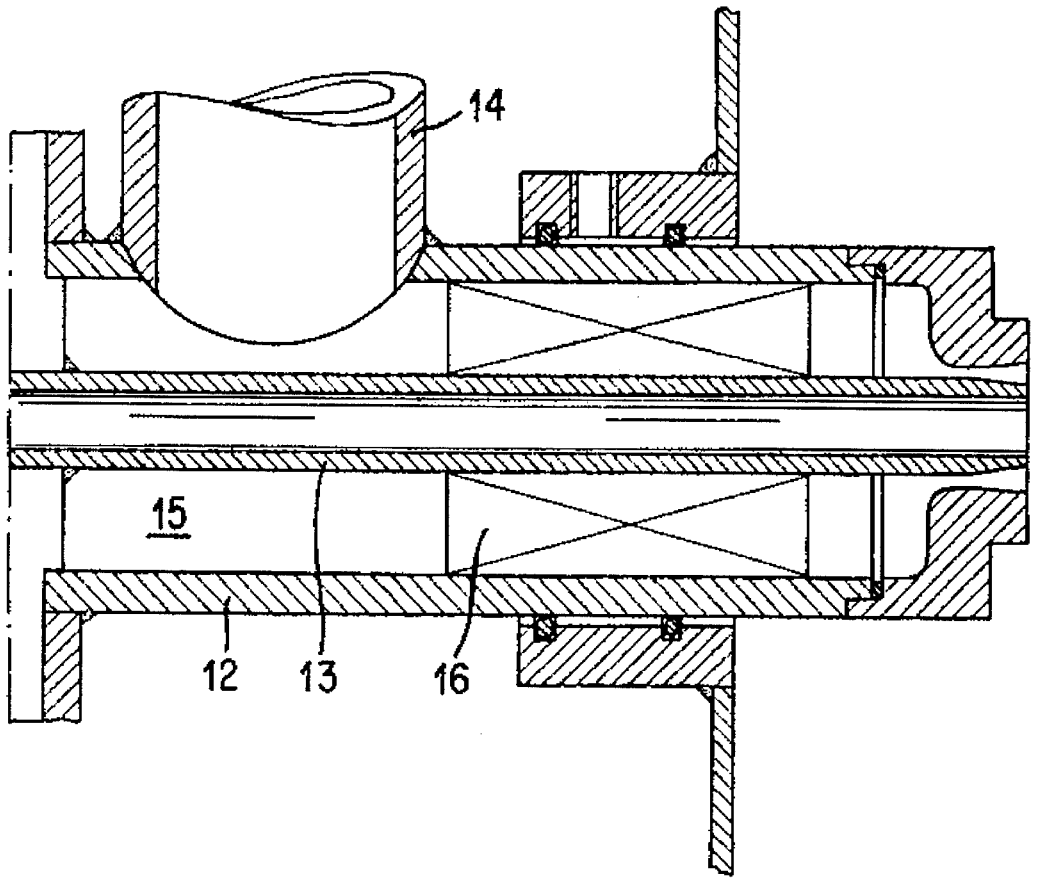
FIG. 2 is a schematic view of an apparatus for performing the process of the invention.

A mixing nozzle, which can be used particularly favorably in the present invention, is represented as a central longitudinal section in FIG. 2.

Referring now to FIG. 2, a tube 13, whose internal diameter is constant and tapers on the outside at one end, which is the nozzle outlet, is arranged in a housing 12. The tube 13 exits through the outlet-side end of the housing 12 with a defined radial clearance, but without projecting beyond a shoulder-like projection of the housing. A suspension fluid, in which granular material is suspended, is introduced into the tube 13 at its inlet end, i.e., the left end of the tube 13 as shown in FIG. 2. An acceleration fluid, which is preferably a gas but which can be a liquid, with or without particles of the type to be crushed added to it, is introduced into the annular space 15 between the tube 13 and the housing 12 via a radial inlet 14. A blade ring 16 ensures that the acceleration fluid leaves the annular space 15 in such a way as to concentrically and uniformly surround the suspension fluid stream exiting from the tube 13 and even mix with the suspension fluid stream from the tube 13, without a substantial amount of energy being removed from the fluid stream as a result. The nozzle according to FIG. 2 may be, e.g., each of the two nozzles 7, 8 of the unit according to FIG. 1. The nozzle of FIG. 2 may be used as one of the nozzles 7, 8 in a unit, which corresponds, in principle, to the unit according to FIG. 1. One nozzle of the type shown in FIG. 2 can be used because an exchange of energy, which leads to the disintegration of the particles, takes place during the collision of solid particles of the suspension 4 with solid particles in the jet discharged from the nozzle of FIG. 2.

Although it is possible for the suspension 4 to consist of a gas and solid particles or of a liquid with solid particles, it is preferably a suspension consisting of a liquid and solid particles.

A gas or a liquid can be discharged from the annular space 15 between the tube 13 and the housing 12 of the nozzle according to FIG. 2. However, the fluid discharged is preferably a gas. The fluid discharged from the space 15 is accelerated, that is, the fluid is introduced through the tube 14 into the annular space 15 where it is accelerated to impart the necessary energy to it.

The suspension caused to enter the nozzle according to FIG. 2 via the inlet to the tube 13 may be a gas or a liquid with solid particles suspended in it. It may be prepared in any desired manner. It is preferably a liquid with solid particles suspended in it. This suspension is also preferably removed from the container 6 (FIG. 1), i.e., it is a portion of the suspension 4, which is removed from the container 6 and is again returned into the container.

The present invention is most effective when the first fluid with the solid particles to be disintegrated, i.e., the suspension 4 in the case according to FIG. 1, already contains a considerable amount of solid particles of low weight, as in the case of modern sifters, because only extremely fine sifted product is intentionally removed from these, i.e., the material returned into the mill still contains a high percentage of relatively finely ground material.

It is to be appreciated that the foregoing is a description of a preferred embodiment of the invention to which variations and modifications may be made without departing from the spirit and scope of the invention.

What is claimed is:

1. A process for impact crushing of solid particles in a suspension stored in a container so that the particles are disintegrated into a plurality of smaller particles, comprising introducing a portion of said suspension into an acceleration nozzle at a first energy level;

introducing an acceleration fluid into said acceleration nozzle at a second energy level higher than said first energy level for accelerating the suspension to form a high energy fluid jet comprising said suspension and said acceleration fluid; and directing said fluid jet into said container for causing said particles in said fluid jet to collide with particles stored in said container for crushing said particles.

2. A process for impact crushing of solid particles according to claim 1 wherein said nozzle has a discharge end disposed within said container, said suspension and said acceleration fluid combining to form said fluid jet within said container.

3. A process for impact crushing of solid particles according to claim 1 wherein one of said suspension and said acceleration fluid is introduced into said nozzle in a direction parallel to the longitudinal axis of said nozzle and the other of said suspension and said acceleration fluid is introduced into said nozzle in a direction parallel to a radius of said nozzle, and said fluid jet exits said nozzle in a direction parallel to the longitudinal axis of said nozzle.

4. A process for impact crushing of solid particles according to claim 1 wherein said acceleration fluid also has particles suspended therein.

5. A process for impact crushing of solid particles in a suspension stored in a container so that said particles are disintegrated into a plurality of smaller particles, comprising introducing a first portion of said suspension into a first acceleration nozzle at a first energy level;

introducing an acceleration fluid into said first acceleration nozzle at a second energy level higher than said first energy level for accelerating the first portion of said suspension to form a first high energy fluid jet; and introducing a second portion of said suspension into a second acceleration nozzle at a third energy level;

introducing an acceleration fluid into said second acceleration nozzle at a fourth energy level higher than said third energy level for accelerating the second portion of said suspension to form a second high energy fluid jet;

directing said first fluid jet into said container; and directing said second fluid jet into said container in a direction which causes the particles in said first fluid jet to collide with the particles in said second fluid jet within the suspension stored in said container.

* * * * *